US008020490B1

(12) United States Patent
Bhansali

(10) Patent No.: US 8,020,490 B1
(45) Date of Patent: Sep. 20, 2011

(54) METHOD OF FABRICATING MEMS-BASED MICRO DETONATORS

(75) Inventor: Shekhar Bhansali, Tampa, FL (US)

(73) Assignee: University of South Florida, Tampa, FL (US)

( * ) Notice: Subject to any disclaimer, the term of this patent is extended or adjusted under 35 U.S.C. 154(b) by 0 days.

(21) Appl. No.: 12/940,593

(22) Filed: Nov. 5, 2010

Related U.S. Application Data

(62) Division of application No. 10/710,627, filed on Jul. 26, 2004, now abandoned.

(60) Provisional application No. 60/481,131, filed on Jul. 24, 2003.

(51) Int. Cl.

| | |
|---|---|
| ***F42B 3/12*** | (2006.01) |
| ***F42B 3/26*** | (2006.01) |
| ***F42B 3/28*** | (2006.01) |
| ***F42B 3/195*** | (2006.01) |
| ***H01L 21/00*** | (2006.01) |

(52) U.S. Cl. ..... 102/202.9; 102/202.12; 102/202.14; 438/26

(58) Field of Classification Search ..... 102/202.5, 102/202.9, 202.12, 202.14; 438/26
See application file for complete search history.

(56) References Cited

U.S. PATENT DOCUMENTS

| | | | | |
|---|---|---|---|---|
| 3,292,537 | A * | 12/1966 | Goss, Jr. | 102/202.9 |
| 3,334,205 | A * | 8/1967 | Griffin | 337/198 |
| 5,969,286 | A | 10/1999 | Ward et al. | |
| 6,146,103 | A | 11/2000 | Lee et al. | |
| 6,640,718 | B2 | 11/2003 | Duguet et al. | |
| 2002/0189487 | A1 | 12/2002 | Kubo et al. | |
| 2003/0200890 | A1 | 10/2003 | Reynolds et al. | |
| 2004/0079301 | A1 | 4/2004 | Perlo et al. | |

OTHER PUBLICATIONS

Bhansali et al., Prototype Feedback-Controlled Bidirectional Actuation System for MEMS Applications, Journal of Microelectromechanical Systems, 2000, vol. 9, No. 2, pp. 245-251.
Cardenas-Valencia et al., A Micro-Fluidic Galvanic Cell as an On-Chip Power Source, Sensors and Actuators B, 2003, vol. 95, pp. 406-413.
Agee et al., Experimental Studies of Explosively-Driven Magnetohydrodynamic Generators, Air Force Research Laboratory, Directed Energy Directorate, Kirtland Air Force Base, New Mexico, pp. 1-36.

* cited by examiner

*Primary Examiner* — Evan Pert
(74) *Attorney, Agent, or Firm* — Jeremy D. Spier; Smith & Hopen, P.A.

(57) ABSTRACT

The present invention provides a novel technique for the fabrication of MEMS igniters and detonators. According to a particular embodiment of the present invention, the device is built based on two-plates. Plate one contains the resistive heating element and plate two contains the explosive cavity. With the present invention, micro igniters and detonators are batch fabricated utilizing a glue-less assembly technique and self-aligning capability.

31 Claims, 7 Drawing Sheets

METHOD OF FABRICATING MEMS-BASED MICRO DETONATORS

CROSS REFERENCE TO RELATED APPLICATIONS

This application claims priority to, and is a divisional of, currently pending U.S. nonprovisional patent application Ser. No. 10/710,627, entitled "METHOD OF FABRICATING MEMS-BASED MICRO DETONATORS," filed on Jul. 26, 2004, which claimed priority to U.S. provisional patent application No. 60/481,131, entitled "FABRICATION OF MEMS-BASED IGNITERS AND DETONATORS," filed on Jul. 24, 2003, the contents of which are all hereby incorporated by reference.

BACKGROUND OF INVENTION

Micro-igniters and detonators being fabricated to date utilize adhesives to integrate the various layers required. The use of adhesives between the fabricated layers requires a large die size and the process introduces the possibility of contamination to the layers.

Recent advances in micro-machined silicon techniques demonstrate the capability for low-cost integrated micro cavities with a high degree of isolation, leading to the fabrication of wafer-based micro detonators that are extremely dense. The resulting micro detonators can be self packaged when separated from the wafer.

Accordingly, what is needed in the art is a lightweight, compact, low power, low cost, reliable MEMS-based micro detonator that can demonstrate the feasibility of mass fabrication.

SUMMARY OF INVENTION

The present invention allows for mass fabrication of igniters and detonators using novel self-locking, and bonding strategies, while keeping the temperatures controllable. The technology allows for significant lowering of cost in the fabrication of igniters and detonators. Through the use of standard or novel materials, i.e. polymers, Si, glass and metal, productivity is increased. The resulting elemental configurations can be integrated with fuses.

In accordance with the present invention, a method of fabricating MEMS-based micro detonators includes forming an explosive cavity in a bottom side of a silicon cavity plate, the explosive cavity comprising a membrane cap positioned on a top side of the silicon cavity plate, forming an igniter element on a top side of a igniter plate, the igniter element having contact pads in electrical contact with the igniter element on the sides and the bottom of the igniter plate, filling the explosive cavity with a primary explosive, and bonding the bottom side of the silicon cavity plate to the top side of the igniter plate to form a micro detonator.

In a particular embodiment, the step of forming a cavity in a silicon cavity plate further includes, providing a silicon wafer having a top side and a bottom side, the top side and the bottom side having an oxide layer, stripping the oxide layer from the top side of the silicon wafer, diffusing boron from the top side of the wafer to provide an etch stop, patterning the bottom side of the wafer using lithography, etching the oxide on the bottom side of the wafer in exposed regions to form an etch mask, stripping the resist from the bottom side of the wafer, bulk etching to form a plurality of cavities having a plurality of membrane caps, the plurality of membrane caps defined by the etch stop, in the bottom side of the wafer. It can be seen that the outlined steps are exemplary in nature and are not meant to limit the scope of the invention.

In an additional embodiment, the step of bulk etching to form a plurality of cavities may include etching with potassium hydroxide.

In addition to the cavity plate, an igniter plate is formed. In a particular embodiment, the step of forming an igniter element on a top side of an igniter plate having contact pads in electrical contact with the igniter element on the sides and the bottom of the igniter plate further includes, depositing conductive material on a bottom side of the igniter plate, depositing the igniter element material on the top side of the igniter plate and patterning to form a plurality of igniter elements, mounting the igniter plate on transfer tape, dicing the igniter plate on the transfer tape to provide a plurality of independent igniter elements in contact with the transfer tape, depositing conductive material to the plurality of independent igniter elements, and patterning the deposited conductive material to establish electrical contact with the igniter element through contact pads on the sides and contact pads on the bottom of the igniter plate. It can be seen that the outlined steps are exemplary in nature and are not meant to limit the scope of the invention.

In a particular embodiment, the step of depositing conductive material on the bottom side of the igniter plate further includes depositing gold by electroplating using lithography.

In an additional embodiment, the step of depositing the igniter element on igniter plate further includes, depositing nickel chromium on the top side of the igniter plate, and patterning using lithography, thereby forming the plurality of igniter elements.

To connect the side contact pads to the bottom contact pads, a variety of methods may be employed, including utilizing a plating technique as known in the art. As such, this design allows for the use of pick-and-place machinery.

Due to the heat sensitivity of the elements employed in the design, the plating technique is performed utilizing a predetermined timing control on the heated process. Depositing conductive material, such as gold, to the plurality of independent igniter elements on the transfer tape, may be accomplished using sputtering techniques known in the art. The sputtering establishes the contact pads on the sides and the bottom of the igniter plates are required for contact with the igniter element.

The explosive cavity may be filled with a primary explosive, utilizing screen printing, spot charging, or other techniques known in the art effective in filling the explosive cavity with primary explosive.

After the cavity plate and the igniter plate have been formed, they are bonded together. The step of bonding the bottom side of the silicon cavity plate to the top side of the igniter plate to form a micro detonator includes, bonding the bottom side of the silicon cavity plate to the top side of the igniter plate using non-degassing epoxies, eutectic bonding or thermal bonding strategies. Additionally, the plates may be bonded using mechanical locking structures. These mechanical locking structures may additionally provide self-alignment.

In addition to a two-plate detonator design, a three-plate design is also within the scope of the present invention. With a three-plate design, the explosive cavity is a through-hole cavity formed in a silicon cavity plate. An additional cap plate is bonded to one side of the cavity plate to form the explosive cavity, the cap plate thereby providing the membrane cap for the device.

In accordance with the present invention—, a MEMS-based micro detonator is provided including, an explosive cavity in a bottom side of a silicon cavity plate, the explosive cavity comprising a membrane cap positioned on a top side of the silicon cavity plate, an igniter element on a top side of an igniter plate, the igniter element having contact pads in electrical contact with the igniter element on the sides and the bottom of the igniter plate, and the bottom side of the silicon cavity plate bonded to the top side of the igniter plate to form a micro detonator.

In a particular embodiment, the igniter element is nickel chromium.

In an additional embodiment, the contact pads are gold.

As such, the design of the MEMS-base detonator in accordance with the present invention allows for a detonator having surface mount capability.

The present invention presents a novel approach to the fabrication of MEMS igniters and detonators. The proposed design and application route enjoys a pick-and-place capability by which a chamber 'cartridge' can be simply placed onto an independent actuation circuit. The approach also provides for side and bottom connects. This is achieved by forming contact pads both on the side or the bottom of the igniter. Various fabrication techniques as well as materials are within the scope of the invention in order to obtain the optimum configuration.

The fabrication method disclosed by the present invention provides a cost savings over the methods of batch fabrication of micro detonators known in the art. The present invention allows for significant lowering of cost in the fabrication, using standard or novel materials, increases productivity and results in element configurations that can be integrated with fuses.

The micro detonators in accordance with the present invention will be applicable for use in a variety of applications, including military applications for medium-caliber air bursting munitions, landmines and demolitions, and commercially for anti tamper applications to protect microelectronics from unwanted exploitation.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

A MEMS-based igniter/detonator in accordance with the present invention, includes a single chamber, of the array of chambers on a silicon wafer, consisting of a cavity filled with explosive material. The explosive charge is heated via a microheater made with NiCr/Poly-Si or other resistor material consistent with the structural materials. The heating of the spotcharge, results in a detonation of the primary explosive.

Figure 1:
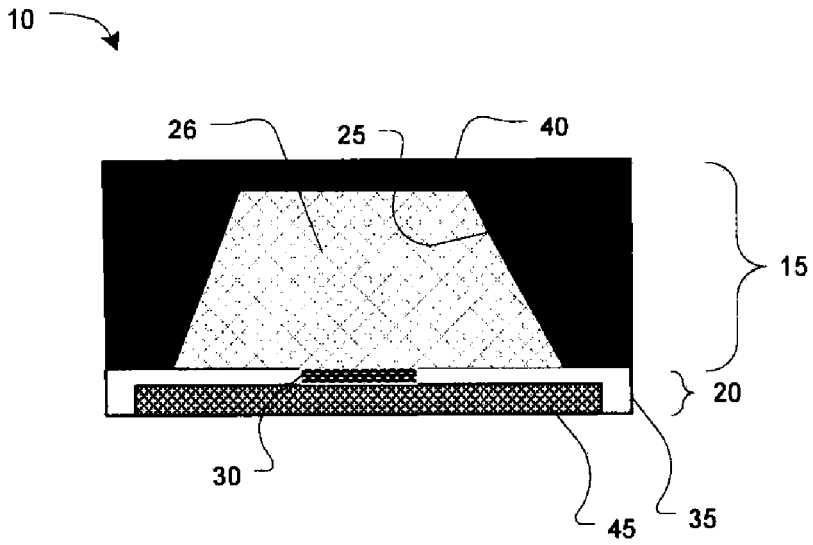
FIG. 1 is a schematic of a micro detonator_as described by the present invention.
Figure 2:
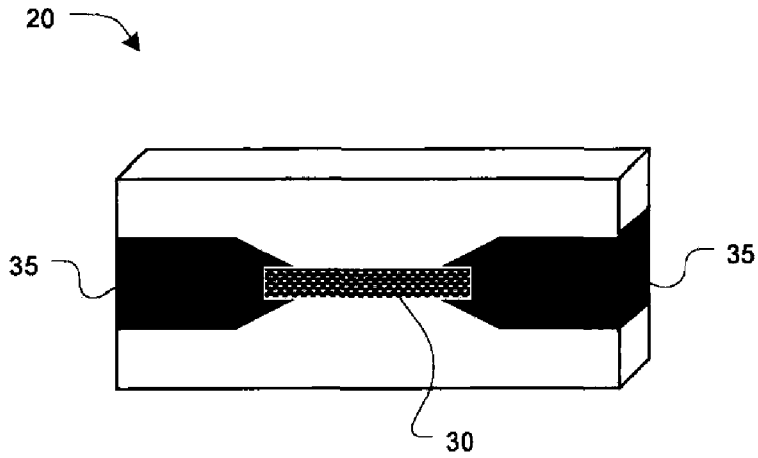
FIG. 2 is a top view of the microheater layer (bottom layer) of the micro detonator as described by the present invention.

Referring to FIG. 1 and FIG. 2, the structure 10 utilizes two layers, top layer 15 and bottom layer 20, each comprising a substrate, which are bonded together. Each of the substrates can be made using a variety of materials, based on design issues dictated by target applications. Top layer 15 forms chamber 25 for explosive 26 while bottom layer 20 contains the micro heating element. FIG. 1 illustrates a side cut-out view of the device and FIG. 2 illustrates a top view of bottom layer 20.

In an exemplary embodiment, top layer 15 consists of an array of chambers 25 etched through Shott glass of 500 μm thickness using deep reactive ion etching (DRIE) techniques, which rely on a high-density plasma source. In a particular embodiment, the length of chamber 25 is 10 mm and the volume of the rectangular channel through which the plasma flows is 6 mm×0.9 mm×300 μm. The etching technique results in chamber membrane cap 40.

Explosive 26 is loaded in the explosive pit (chamber 25) of volume 1.5 mm×2 mm×300 μm. The amount of lead styphnate in the explosive pit (chamber 25) comes to 0.9 mg. Bottom layer 20 contains a matching of poly-silicon micro-resistors 30, which forms the igniter element. A typical resistor design is shown in FIG. 2. Resistors 30 are fabricated on top of 3 μm $SiO_2$ insulating layer 45. Resistors 30 are electrically connected to the bottom of the igniter element plate (bottom layer 20) through contact pads 35 on the sides of igniter element plate (bottom layer 20). Top layer's 15 chambers 25 are filled with lead styphnate and bonded with bottom layer 20 containing micro-resistors 30 to form the MEMS-based micro detonator in accordance with the present invention.

The present invention provides a novel method to establish the necessary connections between the substrates. The novel manufacturing approach provides a method for fabricating contact pads 35 and bottom interconnects that allows the use of existing technologies and surface mount technologies to electrically connect the igniter/detonator.

Figure 3:
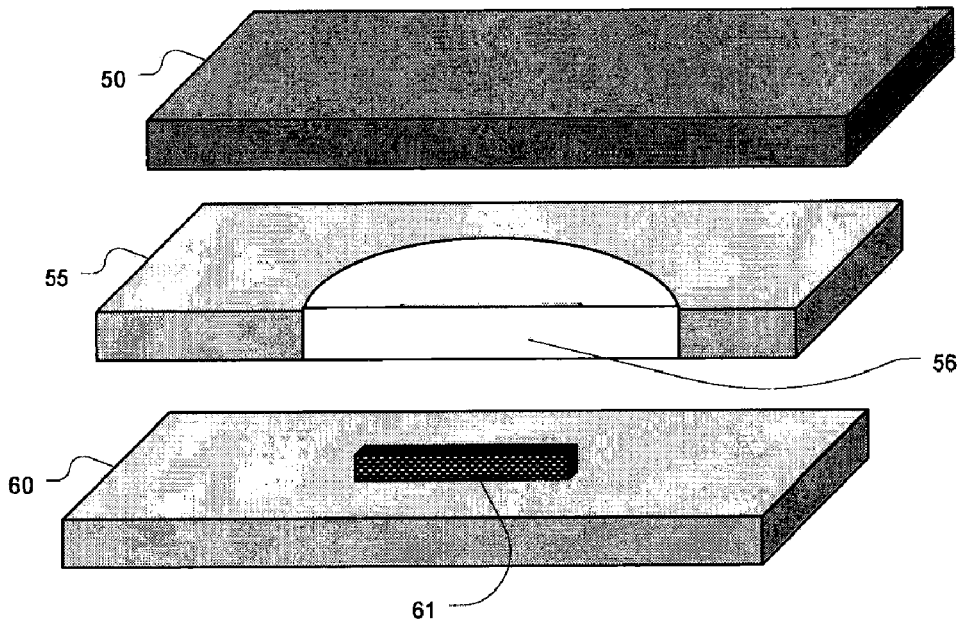
FIG. 3 is an illustrative view of the cross section of a three-plate version of the igniter as described by the present invention.
Figure 4:
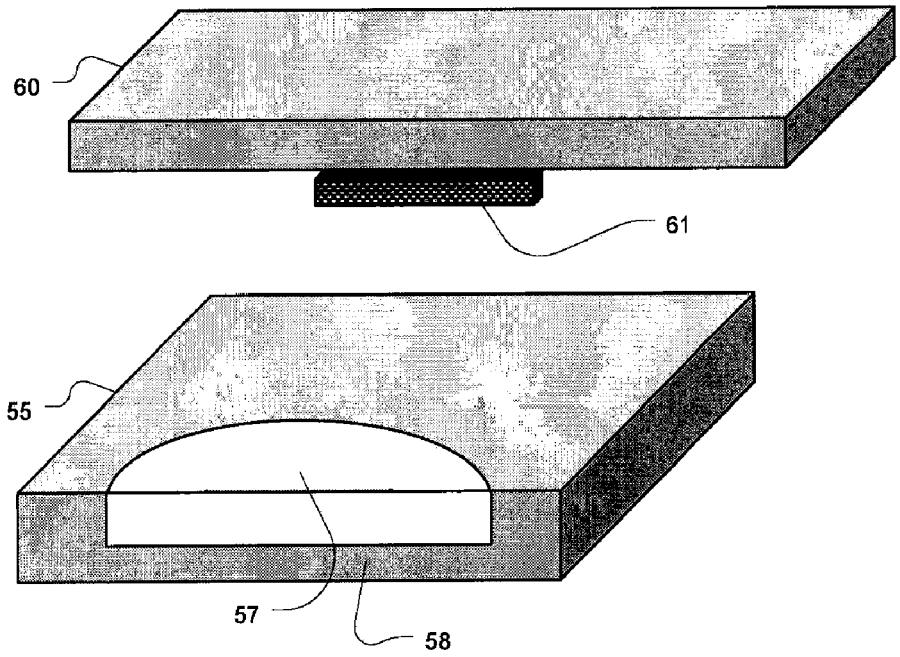
FIG. 4 is an illustrative view of the cross section of a two-plate version of the igniter as described by the present invention.

The micro-igniter of the present invention may be presented in a three-plate version, as shown in FIG. 3 or a two-plate version, as shown in FIG. 4. When utilizing three plates, plate one 60 contains heating element 61, plate two 55 contains through-hole cavity 56 and plate three 50 is the lid. When utilizing two plates, as shown in FIG. 4, plate one 60 contains heating element 61 and plate two 55 contains cavity 57 and associated membrane cap 58.

Embodiments of the present invention provide novel approaches to integration of the top and bottom elements. These novel approaches include low temperature bonding and "glueless" bonding.

Numerous fabrication processes can be used to fabricate the igniter modules based upon the materials being employed. The materials used are dictated primarily by the end-use application. In a preferred embodiment of the present invention, Si, glass, metal, polymers, and ceramics are compatible materials for fabrication of the device.

Figure 5A:
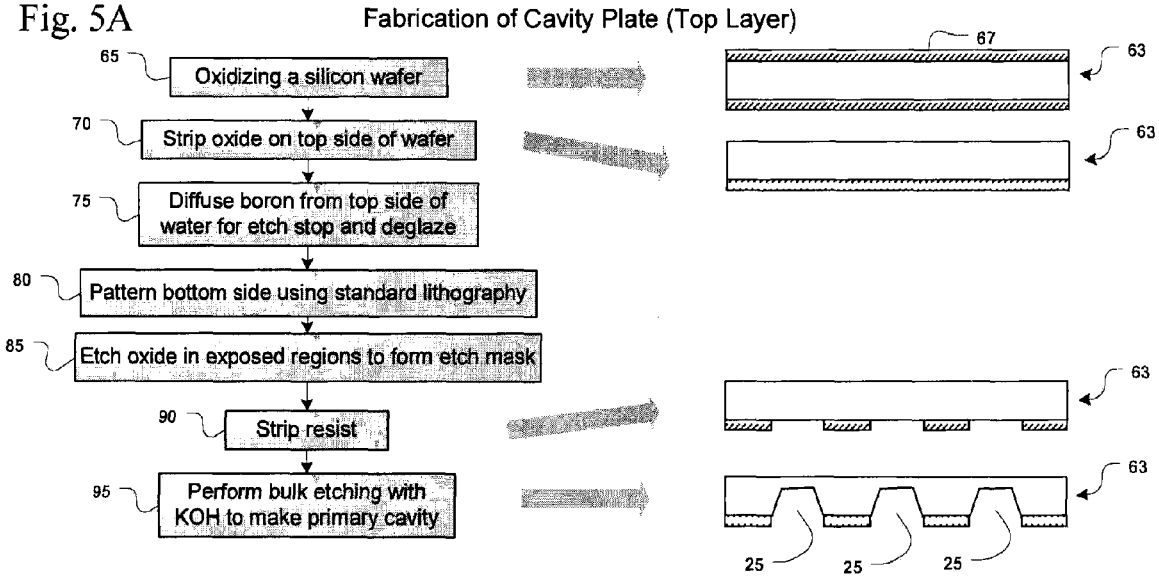
FIGS. 5A-5C are flow charts of the fabrication method as disclosed by the present invention.
Figure 5B:
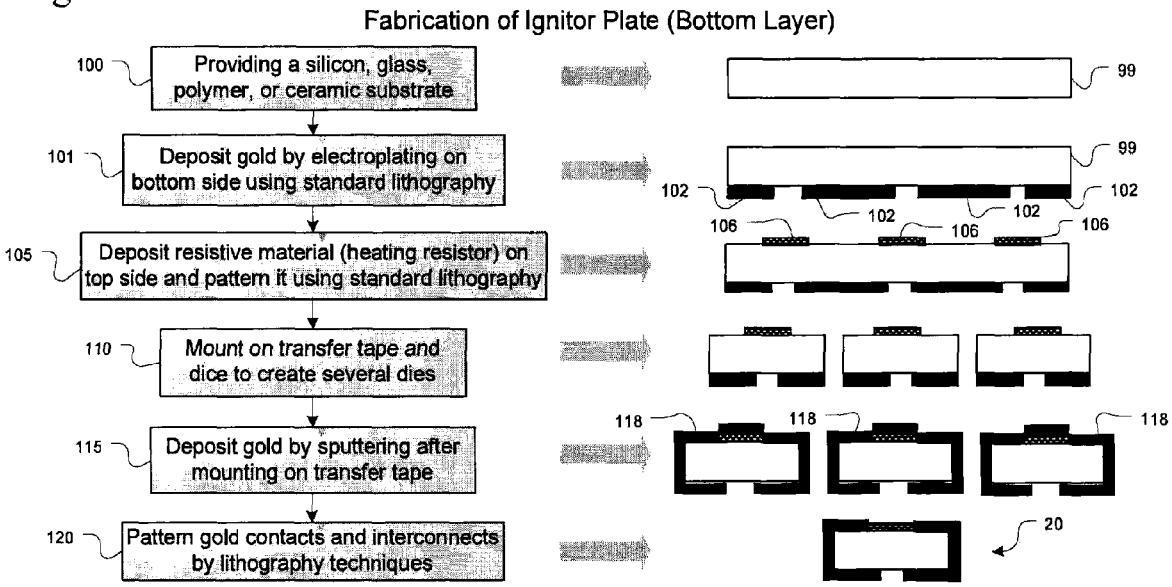
Figure 5C:
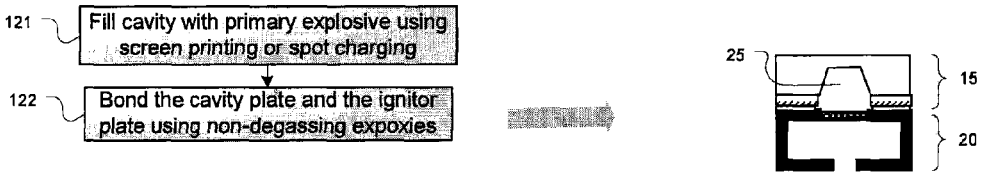

To illustrate the steps identified above, a detailed process flow is shown in FIGS. 5A, 5B, and 5C.

In an exemplary embodiment, as shown with reference to FIG. 5A, fabrication of, top layer 15, employing a bulk silicon approach, establishes trapezoidal chambers 25 being etched using standard lithography and etching techniques. In accordance with this exemplary embodiment, oxidized silicon wafer 63 is provided in operation 65. Next, in operation 70, top oxide layer 67 is stripped from the top side of oxidized wafer 63. A boron etch stop is used to dictate the thickness of the membrane cap. The boron is diffused from the top side of the wafer and deglazed in operation 75. The bottom side of the wafer is patterned using standard lithography in operation 80. Next, in operation 85, the oxide is etched to expose regions to form the etch mask and then in operation 90, the resist is stripped. In operation 95, bulk etching is performed using potassium hydroxide to form chambers 25. In an additional embodiment, deep reactive ion etching can make high aspect ratio cylindrical structures. In an additional step, electroplating over a sacrificial resist results in a metal structure with a cavity of the required size.

The igniter plate (bottom layer 20) is also fabricated in accordance with the present invention as shown with reference to FIG. 5B. Bottom layer 20 has a heating element, and can be formed either on silicon, glass, polymer or ceramic substrates. In accordance with an exemplary method of the present invention in operation 100, silicon, glass, polymer, or ceramic substrate 99 is provided and in operation 101, gold 102 is deposited by electroplating on the bottom side of substrate 99 using standard lithography. Next, in operation 105, resistive material, e.g., NiCr, is deposited on substrate 99 and patterned using standard lithography techniques thus forming the heating resistor. The present invention provides a novel technique for the fabrication of the gold contacts used to establish the electrical connection between top layer 15 and bottom layer 20. The electrical contacts for the bottom side of bottom layer 20 are formed on the wafer using lithography and gold metallization in operation 101. The heating elements on the topside are protected by lithography in operation 105. Then, in operation 110, the wafers are mounted on a transfer tape and diced to create several independent dies that are now attached to the transfer tape. Contact metal 118, such as, gold, is then sputtered on the diced samples in operation 115 and the gold contacts patterned in operation 120 to form contact metal pads and also the side walls of each die. The side and bottom metallization are then connected by standard plating techniques, with precise time control, after the igniter plate and the cavity plate have been bonded.

The MEMS-based detonator device is formed by bonding the cavity plate (top layer 15) and the igniter plate (bottom layer 20). With reference to FIG. 5C, in operation 121, chamber 25 is filled with the primary explosive using screen printing or spot charging and, in operation, 122 top layer 15 and bottom layer 20 are bonded together using non-degassing epoxies.

Figure 6A:
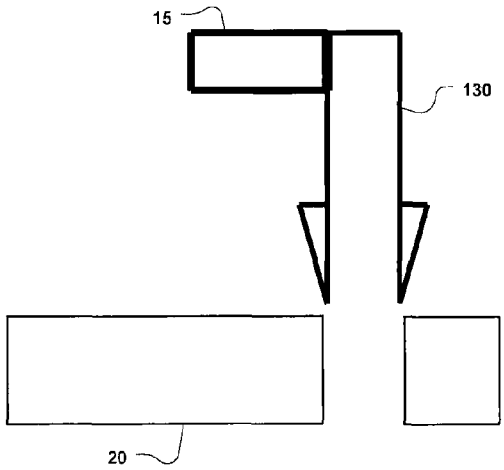
FIGS. 6A-6B are diagrammatic views of a locking mechanism as described by the present invention utilizing plates.
Figure 6B:
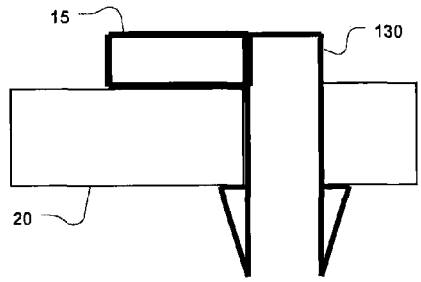
Figure 7:
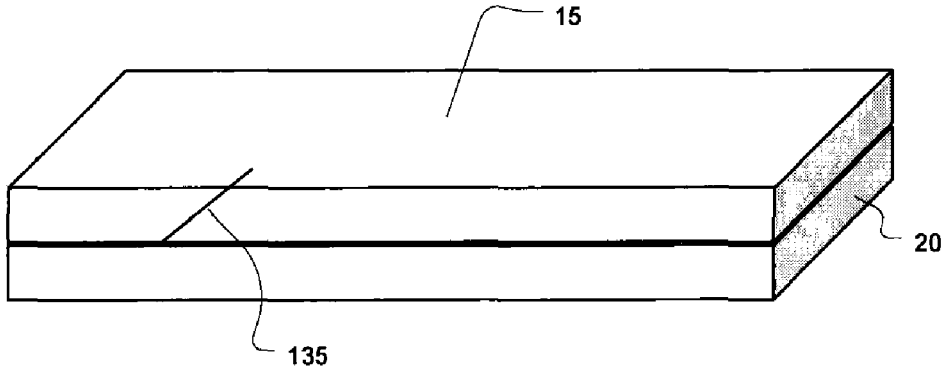
FIG. 7 is a diagrammatic view of a locking mechanism as described by the present invention utilizing radiation scanning.

In an additional embodiment of the present invention, the use of self-aligning, locking mechanisms is employed. As shown in FIG. 6 and FIG. 7, novel adhesive-free locking mechanisms 130, 135 are within the scope of the present invention. As shown with reference to FIGS. 6A and 6B, in a preferred embodiment, self-aligning mechanical locking mechanism 130 is used to build and package the device including top layer 15 and bottom layer 20. FIG. 6B shows the device in the assembled state. In an additional embodiment as shown with reference to FIG. 7, fusion bonding 135 of top layer 15 and bottom layer 20, using heat provided by micro resistors, lasers or local heaters, is used. The use of immediate layers, such as in eutectic bonding is also within the scope of the present invention.

It will be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween. Now that the invention has been described,

The invention claimed is:

1. A method of fabricating MEMS-based micro detonators, the method comprising the steps of:

forming an explosive cavity in a bottom side of a silicon cavity plate, the explosive cavity comprising a membrane cap positioned on a top side of the silicon cavity plate;

forming an igniter element on a top side of an igniter plate, the igniter element having contact pads in electrical contact with the igniter element on sides and bottom of the igniter plate;

filling the explosive cavity with a primary explosive; and bonding the bottom side of the silicon cavity plate to the top side of the igniter plate to form a micro detonator.

2. The method of claim 1, wherein the step of forming a cavity in a silicon cavity plate further comprises:

providing a silicon wafer having a top side and a bottom side, the top side and the bottom side having an oxide layer;

stripping the oxide layer from the top side of the silicon wafer;

diffusing boron from the top side of the wafer to provide an etch stop;

patterning the bottom side of the wafer using lithography;

etching the oxide on the bottom side of the wafer in exposed regions to form an etch mask;

stripping the resist from the bottom side of the wafer;

bulk etching to form a plurality of cavities having a plurality of membrane caps, the plurality of membrane caps defined by the etch stop, in the bottom side of the wafer.

3. The method of claim 1, wherein the step of forming an igniter element on a top side of an igniter plate having contact pads in electrical contact with the igniter element on the sides and the bottom of the igniter plate further comprises:

depositing conductive material on a bottom side of the igniter plate;

depositing the igniter element material on the top side of the igniter plate and patterning to form a plurality of igniter elements;

mounting the igniter plate on transfer tape;

dicing the igniter plate on the transfer tape to provide a plurality of independent igniter elements in contact with the transfer tape;

depositing conductive material to the plurality of independent igniter elements;

patterning the deposited conductive material to establish electrical contact with the igniter element through contact pads on the sides and contact pads on the bottom of the igniter plate.

4. The method of claim 3, wherein the step of depositing conductive material on the bottom side of the igniter plate further comprises depositing gold by electroplating using lithography.

5. The method of claim 3, wherein the step of depositing the igniter element on igniter plate further comprises:

depositing nickel chromium on the top side of the igniter plate; and patterning using lithography, thereby forming the plurality of igniter elements.

6. The method of claim 3, wherein the step of depositing conductive material on a bottom side of the igniter plate, further comprises depositing gold by electroplating using lithography.

7. The method of claim 3, further comprising the step of connecting the contact pads on the sides to the contact pads on the bottom utilizing a plating technique.

8. The method of claim 7, wherein the plating technique is performed utilizing a predetermined timing control.

9. The method of claim 3, wherein the step of depositing conductive material to the plurality of independent igniter elements, further comprises depositing gold by sputtering.

10. The method of claim 1, wherein the step of filling the explosive cavity with a primary explosive further comprises, screen printing to fill the explosive cavity with primary explosive.

11. The method of claim 1, wherein the step of filling the explosive cavity with a primary explosive further comprises, spot charging to fill the explosive cavity with primary explosive.

12. The method of claim 1, wherein the step of bulk etching to form a plurality of cavities having a plurality of membrane caps, further comprise etching with potassium hydroxide.

13. The method of claim 1, wherein the step of bonding the bottom side of the silicon cavity plate to the top side of the igniter plate to form a micro detonator further comprises, bonding the bottom side of the silicon cavity plate to the top side of the igniter plate using non-degassing epoxies.

14. The method of claim 1, wherein the step of bonding the bottom side of the silicon cavity plate to the top side of the igniter plate to form a micro detonator further comprises, bonding the bottom side of the silicon cavity plate to the top side of the igniter plate using mechanical locking structures.

15. The method of claim 14, wherein the mechanical locking structures are self-aligning.

16. The method of claim 1, wherein the step of bonding the bottom side of the silicon cavity plate to the top side of the igniter plate to form a micro detonator further comprises, bonding the bottom side of the silicon cavity plate to the top side of the igniter plate using eutectic bonding.

17. The method of claim 1, wherein the step of bonding the bottom side of the silicon cavity plate to the top side of the igniter plate to form a micro detonator further comprises, bonding the bottom side of the silicon cavity plate to the top side of the igniter plate using thermal bonding strategies.

18. The method of claim 1, wherein the step of forming an explosive cavity in a bottom side of a silicon cavity plate, the explosive cavity comprising a membrane cap positioned on a top side of the silicon cavity plate further comprises:

forming a through-hole explosive cavity in a bottom side of a silicon cavity plate; and forming a membrane cap in a cap plate, the cap plate positioned and bonded to the cavity plate to form the explosive cavity in the bottom side of the silicon cavity plate.

19. The method of claim 18, wherein the step of forming a through-hole cavity in a silicon cavity plate further comprises:

providing a silicon wafer having a top side and a bottom side, the top side and the bottom side having an oxide layer;

stripping the oxide layer from the top side of the silicon wafer;

patterning the bottom side of the wafer using lithography;

etching the oxide on the bottom side of the wafer in exposed regions to form an etch mask;

stripping the resist from the bottom side of the wafer; and bulk etching to form a plurality of cavities in the bottom side of the wafer.

20. A MEMS-based micro detonator comprising:

an explosive cavity in a bottom side of a silicon cavity plate, the explosive cavity comprising a membrane cap positioned on a top side of the silicon cavity plate; and an igniter element on a top side of an igniter plate, the igniter element having contact pads in electrical contact with the igniter element on sides and bottom of the igniter plate, wherein the bottom side of the silicon cavity plate is bonded to the top side of the igniter plate to form a micro detonator.

21. The MEMS-based micro detonator of claim 20, wherein the explosive cavity further comprises, a primary explosive filling.

22. The MEMS-based micro detonator of claim 20, wherein the igniter element is nickel chromium.

23. The MEMS-based micro detonator of claim 20, wherein the contact pads are gold.

24. The MEMS-based micro detonator of claim 20, wherein the contact pads on the sides of the igniter plate and the contact pads on the bottom of the igniter plate form an electrical contact with the igniter element to establish a detonator having surface mount capability.

25. The MEMS-based micro detonator of claim 20, wherein the igniter plate is silicon.

26. A MEMS-based micro detonator comprising:

an explosive through-hole cavity in a bottom side of a silicon cavity plate;

a membrane cap in a cap plate, the cap plate positioned and bonded to the cavity plate to form an explosive cavity in the bottom side of the silicon cavity plate; and an igniter element on a top side of an igniter plate, the igniter element having contact pads in electrical contact with the igniter element on sides and bottom of the igniter plate, wherein the bottom side of the silicon cavity plate is bonded to the top side of the igniter plate to form a micro detonator.

27. The MEMS-based micro detonator of claim 26, wherein the explosive cavity further comprises, a primary explosive filling.

28. The MEMS-based micro detonator of claim 26, wherein the igniter element is nickel chromium.

29. The MEMS-based micro detonator of claim 26, wherein the contact pads are gold.

30. The MEMS-based micro detonator of claim 26, wherein the contact pads on the sides of the igniter plate and the contact pads on the bottom of the igniter plate form an electrical contact with the igniter element to establish a detonator having surface mount capability.

31. The MEMS-based micro detonator of claim 26, wherein the igniter plate is silicon.

* * * * *